United States Patent [19]

Higgins

[11] 4,127,465

[45] Nov. 28, 1978

[54] FILM PROCESSING APPARATUS FOR THE ELECTROLYTIC RECOVERY OF SILVER

[75] Inventor: David L. Higgins, Palos Verdes Estates, Calif.

[73] Assignee: Ag-Met, Inc., Lofty, Pa.

[21] Appl. No.: 681,605

[22] Filed: Apr. 29, 1976

Related U.S. Application Data

[62] Division of Ser. No. 534,159, Dec. 19, 1976, Pat. No. 3,980,538.

[51] Int. Cl.[2] ..... C25D 21/12; C25C 1/20

[52] U.S. Cl. ..... 204/228; 204/109

[58] Field of Search ..... 204/105 R, 109, 228, 204/237, 238

[56] References Cited

U.S. PATENT DOCUMENTS

| | | | |
|---|---|---|---|
| 3,418,225 | 12/1968 | Wick et al. | 204/228 X |
| 3,463,711 | 8/1969 | Geyken | 204/109 |
| 3,616,435 | 10/1971 | Favell | 204/109 X |
| 3,925,184 | 12/1975 | Cave | 204/228 X |

*Primary Examiner*—John H. Mack
*Assistant Examiner*—D. R. Valentine
*Attorney, Agent, or Firm*—Fitzpatrick, Cella, Harper & Scinto

[57] ABSTRACT

Silver is recovered from used film plates by passing them into a solution into which their silver material is dissolved and by electroplating the dissolved silver out of the solution. Electrical circuits are provided to increase the magnitude of a continuous plating current in proportion to the rate of film and silver input and to decrease the current gradually to coincide with the decrease in silver concentration as plating continues.

11 Claims, 3 Drawing Figures

FILM PROCESSING APPARATUS FOR THE ELECTROLYTIC RECOVERY OF SILVER

This is a division of application Ser. No. 534,159, filed Dec. 19, 1976, now U.S. Pat. No. 3,980,538.

BACKGROUND OF THE INVENTION

1. Field of the Invention

This invention relates to the electrolytic recovery of metals and more particularly it concerns novel methods and apparatus for monitoring and regulating current in an electrolytic bath.

2. Description of the Prior Art

U.S. Pat. Nos. 3,418,225, 3,450,622, 3,463,711, 3,551,318 and 3,616,435 all relate to the recovery of silver from used photographic or X-ray plates. In the systems described in those patents silver bearing material is dissolved off from a film plate as it passes through a solution; and then the silver is recovered by subjecting the solution to electrolytic action so that the silver plates out onto a removeable electrode. Various arrangements are provided for control of the electrical current through these solutions, including means for maintaining current flow for given lengths of time corresponding to the size and number of film plates passing through the solution. Means are also provided for manually adjusting the magnitude of current flow.

In U.S. Pat. No. 3,067,123 there are shown, in an electrolytic bath, a pair of probe electrodes which sense the current flow in an electrolytic bath and feed back a signal to drive a potentiometer so that the current flow is maintained at a constant or fixed value.

None of the prior art provides any capability for maintaining a continuous flow of current through an electrolytic bath and adjusting the magnitude of this current to coincide with changes in metal concentration in the bath as more metal is added to the solution and as more metal is plated out from solution.

SUMMARY OF THE INVENTION

The present invention overcomes the foregoing deficiencies of the prior art and provides novel arrangements for controlling the current flow in an electrolytic bath so that the current flow at any instant coincides in general, with the present concentration, in the bath, of metal to be recovered. Thus in the preferred embodiment, where silver is to be recovered from used photographic or X-ray plates which pass through a solution into which their silver bearing matter dissolves, there is provided a pair of plating electrodes in the solution with special current control means which maintains a maximum flow current between the electrodes corresponding to the concentration of silver in the solution.

As more film plates pass into the solution the concentration of silver therein increases and as electroplating onto one of the electrodes continues, the concentration of silver in the bath decreases. It is desired to maintain maximum plating current through the bath between the electrodes because this maximizes the rate of silver recovery. If too large a voltage is applied to the electrodes, however, in an attempt to force more current through the solution a phenomenon known as "sulphiding" occurs at the cathode and the silver plated thereon becomes contaminated. In general the amount of current that can be tolerated in the bath corresponding to the concentration of silver in the bath, so that as silver concentration increases more current may be employed and as silver concentration decreases, less current must be employed.

According to one feature of the present invention there are provided current control means which operate in response to events which increase metal concentration, e.g. the entry of film plates into a processing operation, to increase plating current and which further operate after each such event to decrease the plating current gradually to coincide, in general, to the concentration of metal, e.g. silver, in the solution. In its preferred embodiment, described in detail hereinafter, the present invention makes use of a charging capacitor which is connected to receive a charge in one direction at a first predetermined rate during the time film plates pass into a processing bath. The capacitor is also arranged to receive a charge in the opposite direction, i.e., a discharge, at a second predetermined rate following the passage of each film plate into the bath. Electronic means, responsive to the charge on the capacitor at each instant, are provided to control the magnitude of current between a pair of plating electrodes placed in the bath.

According to one specific feature of the invention special discharge control means are provided which operate in response to the maximum charge produced on the capacitor to increase its discharge rate accordingly so that the increased rate of reduction in metal concentration in the bath, which occurs when high plating currents are used, is accompanied by a corresponding increase in the rate of reduction of the plating current itself.

In other aspects the present invention provides novel electronic circuits for carrying out the foregoing and novel electronic circuits for monitoring its own operation and for signalling the occurrence of any abnormality.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures or methods for carrying out the several purposes of the invention. It is important, therefore, that the claims be regarded as including such equivalent constructions and methods as do not depart from the spirit and scope of the invention.

BRIEF DESCRIPTION OF THE DRAWINGS

One embodiment of the invention has been chosen for purposes of illustration and description, and is shown in the accompanying drawings forming a part of the specification, wherein.

DETAILED DESCRIPTION OF THE PREFERRED EMBODIMENT

Figure 1:
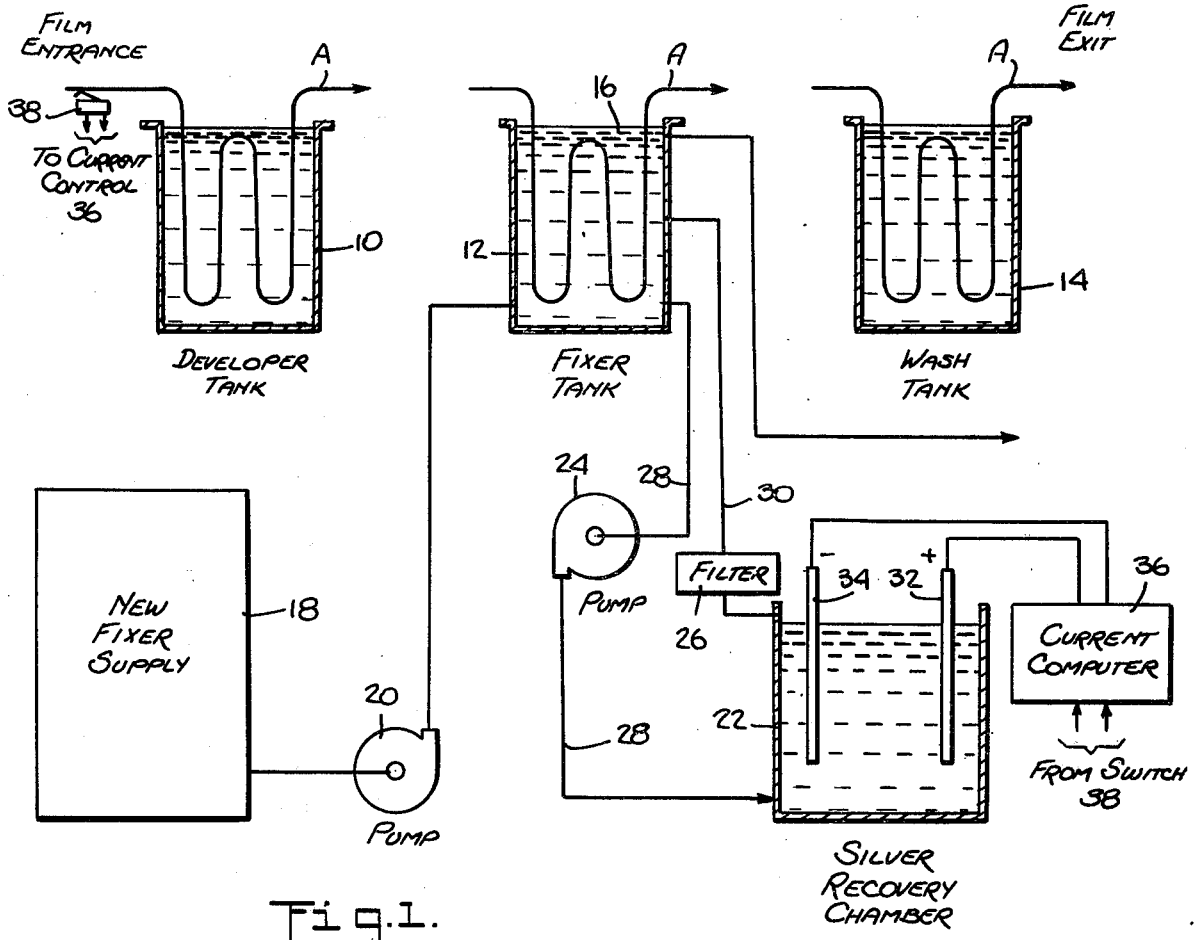
FIG. 1 is a diagrammatic representation of a film processing system in which the present invention is embodied.

In the film processing system of FIG. 1, photographic film plates, which have been exposed in a camera or X-ray machine, are processed by developing and fixing images thereon. This development and fixing is carried out in a manner such that metallic silver is recovered from the surfaces of the film.

As shown in FIG. 1, film to be processed passes along a path indicated by the arrows A. This path leads first through a developer tank 10, then through a fixer tank 12 and finally through a wash tank 14. The chemistry of this film processing operation is not part of this invention and will not be discussed herein except to say that in the fixer tank 12, silver containing materials become removed from the surface of the film and are dissolved into a fixer solution 16 contained within the tank. As the film moves out of the tank 12 it takes with it some of the fixer solution and so a replenishment arrangement is provided comprising a new fixer supply 18 and a new fixer pump 20 connected to transfer new fixer from the supply 18 to the fixer tank 12.

A silver recovery arrangement is provided and comprises a silver recovery chamber 22, a recycling pump 24 and a filter 26. A pump 24 is connected along a recovery conduit 28 to transfer silver containing solution from the fixer tank 12 to the recovery chamber 22. A return conduit 30 transfers silver free solution back to the fixer tank 12 through a filter 26.

The silver recovery chamber 22 is provided with a pair of electrodes, i.e., an anode 32 and a cathode 34, which are connected, respectively, to a current control module 36. The current control module, as will be described more fully hereinafter, serves to maintain proper potential between the anode 32 and cathode 34 so that maximum effective electrical current passes through the solution in the chamber consonant with the concentration of silver therein.

Silver concentration within the recovery chamber 22 is affected by the rate at which film passes through the system. This is measured by a film sensing switch 38 at the entrance to the developer tank 10. As indicated in FIG. 1, the switch 38 is connected to the current control module 36.

Figure 2:
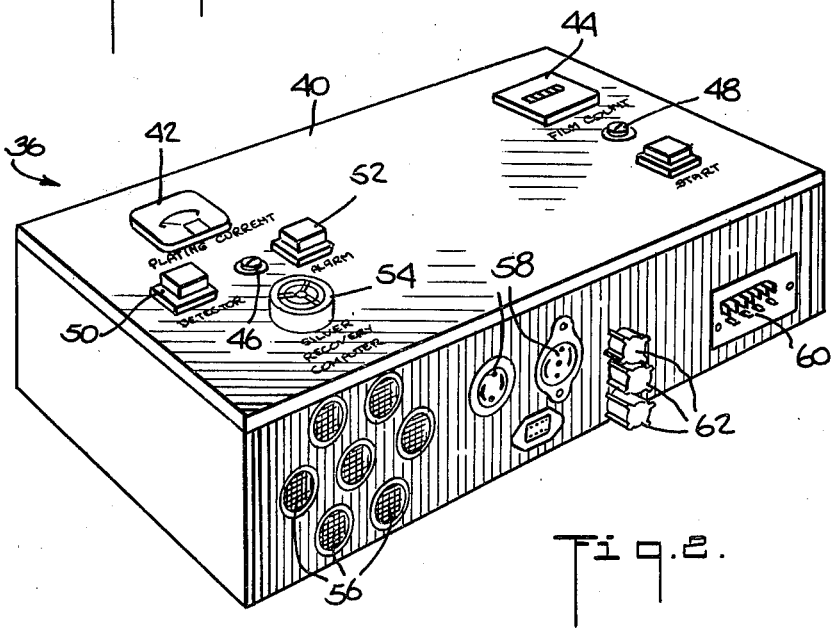
FIG. 2 is a perspective view of a current control module used in the system of FIG. 1.

As shown in FIG. 2, the current module 36 is contained within a box-like housing 40. The housing is provided with various meters and control buttons for accommodating different operating conditions. These meters include a plating current meter 42 for continuous observation of the magnitude of electrical current passing through the bath between the anode and cathode 32 and 34. There is also provided a film counter 44 for registering the number of film plates which pass through the processing system. The controls of the module 36 include a power cutoff button 46 and a processor mode select switch 48. The mode select switch is operated to allow proper operation of the unit at more than one film processing speed. There are also provided first and second indicator lamps 50 and 52 and an acoustical alarm 54. These lamps and acoustical alarm operate in the following various ways to signal the following abnormal operating conditions:

Firstly, if the magnitude of the plating current through the bath in the recovery chamber 22 is too low or too high, the indicator lamp 52 will illuminate and the acoustical alarm 54 will sound.

Secondly, if the temperature within the housing 40 becomes too high, e.g. greater than 160° F., then current to the electrodes will be terminated. Also, the indicator lamp 52 and the acoustical alarm 54 will be energized since they will then sense a drop in current level.

Thirdly, should the switch 38 become stuck or jammed so that it remains closed even after a film plate has passed beyond it, the indicator lamp 50 and the acoustical alarm 54 will be energized. This last mentioned alarm energization will occur at approximately 60 seconds following closure of the switch 38 if the switch has not opened in the meantime.

Finally, when the system has been switched to process continuous strip film so that the switch 38 is purposely held closed longer than 30 seconds, the second indicator lamp 50 remains illuminated and the acoustical alarm is caused to operate periodically.

The module housing 40 additionally contains ventilation ports 56 to assist in cooling the electrical components contained therein. There are also provided input connectors 58 for supplying electrical power to the system and outlet connectors 60 for connection to the electrodes 32 and 34 and to the switch 38. Fuses 62 are also arranged on the front of the housing 40 for easy replacement.

Figure 3:
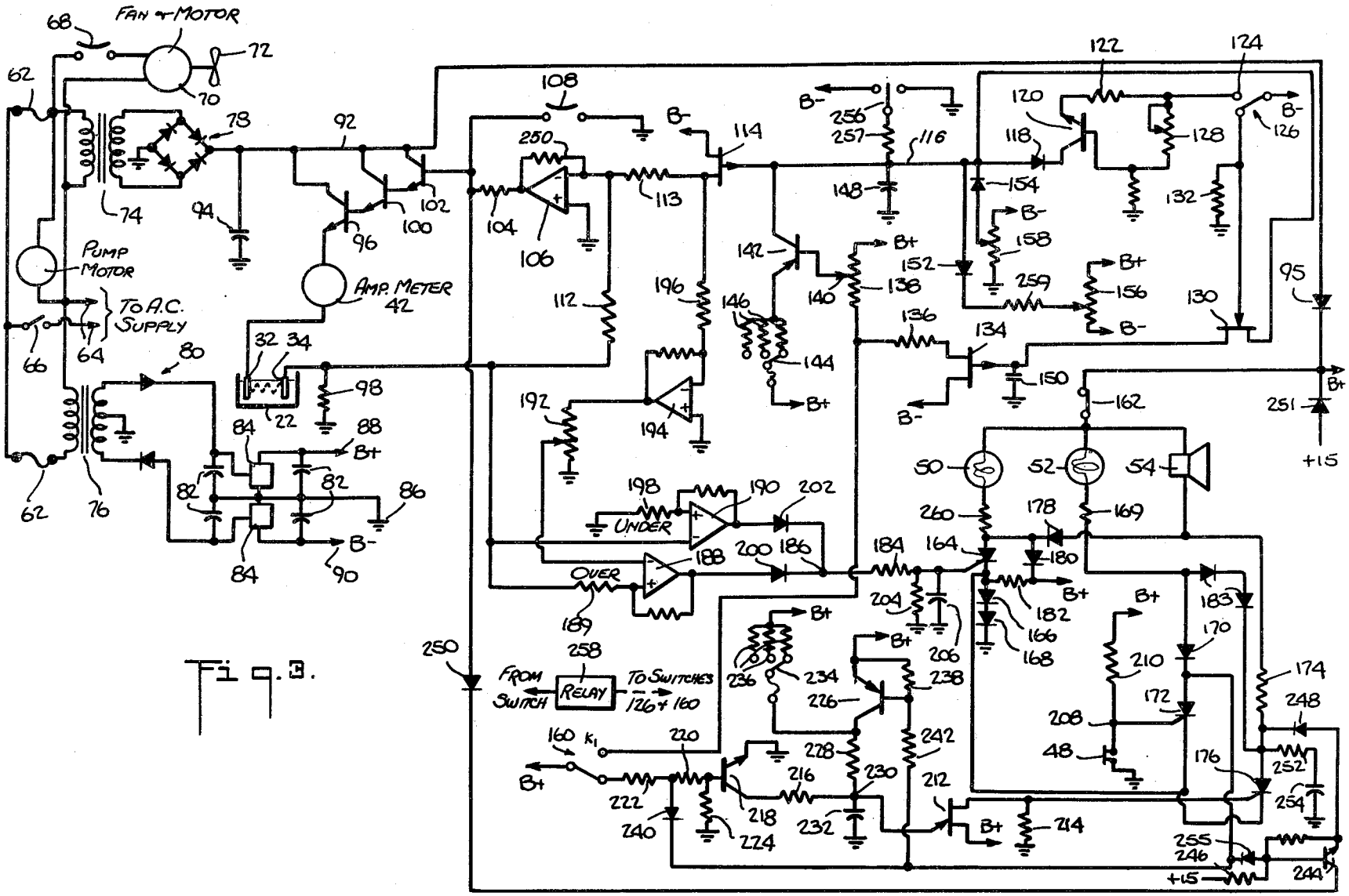
FIG. 3 is a circuit diagram showing the electrical arrangements within the control module of FIG. 2.

The circuits and related components contained within the housing 40 are shown in FIG. 3. As shown in FIG. 3 there are provided power input terminals 64 which receive AC electrical power via one of the input connectors 58. A main switch 66 is connected in series with one of the terminals 64 to control all electrical power to the system. This main switch is arranged to be operated by the power cutoff button 46 on the housing. The terminals 64 are connected through the main switch 66 and one of the fuses 62 to a first pump motor to operate the recycling pump 24 (FIG. 1) continuously. The input terminals are also connected through the same fuse and a first temperature sensing switch 68 to operate a fan motor 70. This motor is connected to drive a fan 72 which is located inside the ventilation ports 56 of the housing 40 (FIG. 2) to blow cooling air over the electrical circuits. The temperature sensing switch is preferably set to close when the temperature within the housing reaches approximately 140° F.

The input terminals 64 are also connected through the fuses 62 to the primary windings of first and second transformers 74 and 76. The secondary windings of these transformers are connected, respectively, to a four diode full wave rectifier bridge circuit 78 and a two diode half wave rectifier circuit 80. The two diode rectifier circuit 80 is provided with smoothing capacitors 82 and voltage regulators 84; and is referenced to common at terminal 86, thereby presenting a positive 15 volt DC potential at a $B^+$ terminal 88 and a negative 15 volt DC potential at a $B^-$ terminal 90. These voltages are applied to various points in the plating current control and alarm circuits of FIG. 3 as will be described.

The output of the full wave rectifier bridge circuit 78 is connected between common voltage and a plating current supply line 92. This supply line is maintained by the first transformer 74 and the rectifier circuit 78 at a positive voltage of approximately 18 volts. A smoothing capacitor 94 is connected between the supply line 92 and common voltage to smooth the pulsating DC which passes through the rectifier bridge circuit 78 so that a steady DC potential remains on the supply line. The supply line 92 is also connected via diode 95 to provide power for the safety circuits. A diode 251 is connected to provide power to to the safety circuit from the $B^+$ terminal 88 in case of a failure of the power supply 78.

A first NPN transistor 96 has its collector connected to the supply line 92 and its emitter connected through the current meter 42 to the anode 32. The cathode 34 is connected through a reference resistor 98 to common voltage. A second NPN transistor 100 has its emitter and collector connected respectively to the supply line 92 and the base of the first transistor 96; and a third transistor 102 has its collector and emitter connected respectively to the supply line 92 and the base of the second transistor 100. This transistor arrangement is known as a "Darlington" configuration; and it serves to provide close control of the magnitude of current flowing from the supply line 92 and between the anode and cathode 32 and 34. The magnitude of this current is established by the current flow through the base of the third transistor 102.

The base of the third transistor 102 is connected via a resistor 104 to the output of an inverting type operational amplifier 106. The base of the transistor 102 is also connected via a normally opened temperature sensitive switch 108 to common potential. The switch 108 is to close and clamp the base of the third transistor 102 to common potential when the ambient temperature becomes unsafe, i.e. when it reaches approximately 160° F. When the switch 108 closes, the Darlington configuration ceases to conduct current from the supply line 92 so that no plating current can flow between the anode and cathode 32 and 34.

The operational amplifier 106 has its positive input terminal connected to ground, and it has its negative input terminal connected through a resistor 112 to the cathode 34. The resistor 250 controls the gain of the operational amplifier 106. The negative input terminal of the operational amplifier 106 is also connected through a resistor 113 to the source terminal of a first P channel type field effect transistor 114. The drain terminal of the field effect transistor is connected to the $B^-$ terminal 90. The gate terminal of the first field effect transistor 114 is connected to a charge control line 116 which extends from the gate terminal and through a first diode 118, the collector and emitter of an NPN type charge control transistor 120 and a resistor 122, to one alternate terminal 124 of a first film actuated single throw, double pole switch 126. A current control resistor 128 is connected between the switch terminal 124 and the base of the transistor 120. The base of the transistor is also connected through a further resistor to ground.

The switch 126 has a common terminal connected to the $B^-$ terminal 90. The remaining terminal of the switch 126 is connected to the gate terminal of an N channel field effect transistor 130. The gate terminal of this transistor is also connected via a further resistor 132 to ground.

The source terminal of the field effect transistor 130 is connected directly to the charge control line 116 while the drain terminal of the transistor 130 is connected directly to the gate terminal of a further P channel type field effect transistor 134. The drain terminal of the transistor 134 is connected to the $B^-$ terminal 90 while the source terminal of the transistor 134 is connected serially through a fixed resistor 136 and a voltage divider resistor 138 to the $B^+$ terminal 88.

An adjustable tap 140 on the voltage divider resistor 138 is connected to the base terminal of a PNP type discharge control transistor 142. The emitter of this transistor is connected via a selection switch 144 and alternately selected resistors 146, of different resistance value, to the $B^+$ terminal 88. The collector of the transistor 142 is connected directly to the charge control line 116.

A main charge control capacitor 148 is connected between the charge control line 116 and common potential, while a discharge control capacitor 150 is connected between the gate terminal of the field effect transistor 134 and common potential. Minimum charge limiting diode 152 and resistor 259 and maximum charge limiting diode 154 are connected between the charge control line 116 and adjustable taps of voltage dividing resistors 156 and 158, respectively. The resistor 156 is connected between the $B^+$ and $B^-$ terminals 88 and 90 while the resistor 158 is connected between common potential and the $B^-$ terminal 90.

There is also provided a second film actuated single throw double pole switch 160 having a common terminal connected to the $B^+$ terminal 88. One of the alternate terminals of the switch 160 is connected to a junction between the fixed resistor 136 and the voltage divider resistor 138.

The portion of the circuits of FIG. 3 which have thus far been described serve to control the flow of electrical current through the bath between the plating electrodes 32 and 34. The remaining portions of the circuits, hereinafter described serve to control the various alarms in the event of a system malfunction.

As shown in FIG. 3 the $B^+$ terminal 88 is connected through diode 251 and an alarm reset switch 162 to one terminal each of the first and second indicator lamps 50 and 52 and the acoustical alarm 54. The remaining terminal of the first indicator lamp 50 is connected through a resistor 260, the anode and cathode of a first SCR switch 164 and through a pair of diodes 166 and 168 to common potential. The remaining terminal of the second indicator lamp 52 is connected through a resistor 169, a diode 170, the anode and cathode of a second SCR switch 174 and then through the diodes 166 and 168 to common potential. The remaining terminal of the acoustical alarm 54 is connected through a resistor 174, the anode and cathode of a third SCR switch 176 and then through the diodes 166 and 168 to common potential. This same remaining terminal of the acoustical alarm is also connected through diode 178 to the SCR switch 164. The diode 180 provides a path for current in case of a failure with $B^+$ 88. The $B^+$ terminal 88 is also connected via a resistor 182 to the cathode of the SCR switch 164. A bypass connection, comprising a pair of diodes 183, is provided between the resistor 169 and the anode of the third SCR switch 176.

The gate terminal of the first SCR switch is connected via a resistor 184 to a junction 186 to which signals from overcurrent and undercurrent detection operational amplifiers 188 and 190 are applied. The over current amplifier 188 has its positive input terminal connected via a resistor 189 to the cathode 34 and its negative input terminal connected to the adjustable tap of a voltage divider resistor 192. The voltage divider resistor in turn is connected between common potential and the output of another inverting operational amplifier 194. This last mentioned operational amplifier has its positive input connected to common potential and its negative input connected through a resistor 196 to the source terminal of the first field effect transistor 114. The undercurrent operational amplifier 190 has its negative input terminal connected to the cathode 34, and its positive input terminal connected via a resistor 198 to common potential. Diodes 200 and 202 are connected between the outputs of the two operational amplifiers 188 and 190, respectively, and the junction 186, to prevent cross coupling of the outputs of these amplifiers. A resistor 204 and a capacitor 206 are connected in parallel between the gate terminal of the first SCR switch 164 and common potential to delay alarm turn on.

The gate terminal of the second SCR switch 172 is connected to a junction 208 between a resistor 210 and the mode select switch 48. The resistor 210 the junction 208 and the mode select switch 48 are connected in series between the B+ terminal 88 and common potential.

The gate terminal of the third SCR switch 176 is connected to one of the base terminals of a unijunction transistor 212. The gate terminal of the third SCR switch is also connected through a resistor 214 to common potential. The other base terminal of the unijunction transistor is connected directly to the B+ terminal 88. The emitter of the unijunction transistor is connected through a resistor 216 to the collector of an NPN type transistor 218. The emitter of that transistor is connected directly to ground; and its base terminal is connected through a pair of resistors, 220 and 222, to the remaining alternate terminal of the second film actuated switch 160. The base terminal of the transistor 218 to also connected through another resistor 224 to common potential.

A PNP transistor 226 has its emitter connected to the B+ terminal 88 and its collector connected through a resistor 228 to a junction 230 between the emitter of the unijunction transistor 212 and the resistor 216. A capacitor 232 is connected between the junction 230 and common potential. The collector of the PNP transistor 226 is also connected through a select switch 234 and one of several resistors 236 of different resistance value to the B+ terminal 88. The emitter of the transistor 226 is connected through a resistor 238 to its base terminal.

A connection is provided from the junction between the two resistors 220 and 222 through a diode 240 to the anode of the second SCR switch 172, and through the diode 240 and a resistor 242 to the base of the PNP transistor 226. The diode 240 is also connected to the base terminal of an NPN transistor 244 through a diode 255.

The base of the transistor 244 is connected to B+ 88 through the resistor 246. The emitter of the transistor 244 is also connected via a diode 248 to the anode of the third SCR switch 176. The collector of the transistor 244 is connected via a diode 250 to the base of the transistor 102.

An alarm pulsing control resistor 252 and capacitor 254 are serially connected between the anode of the third SCR switch 176 and common potential.

There is also provided a manually operated plating current control arrangement comprising a three position manual switch 256 having its common terminal connected via a resistor 257 to the charge control line 116. In its center position, as shown, the switch makes no connection from the charge control line. In its two other positions the switch connects the charge change control line to the common potential terminal 86 and the B− terminal 90 respectively.

The first and second single throw double pole switches 126 and 160 are arranged to be operated in unison by energization of a relay 258. The relay 258 is connected to be energized upon closure of the film sensing switch 38. The switch 38 is normally closed and it becomes opened while a film plate is passing over it and entering the film processing system. During this time the relay 258 is deenergized. On the other hand, when no film is entering the system, the switch 38 reverts to its normally closed state to maintain energization of the relay 258. The switches 126 and 160 are shown in their relay energized condition, i.e. with no film entering the system.

During operation of the system described above, film plates of various length pass by the switch 38 as they enter the developer tank 10. These film plates, while of different length, are of substantially uniform width, and they travel at a substantially uniform speed. Therefore the duration of actuation or opening of the switch 38 corresponds to the total surface area of the film plates which have entered the system. This in turn corresponds to the amount of silver which is being dissolved into the fluid in the fixer tank 12.

In operation, the circuit of FIG. 3 maintains a maximum current flow between the anode and cathode 32 and 34 for most efficient recovery of the dissolved silver. On the other hand, the circuit also prevents the anode and cathode from being subjected to an excessive voltage differential. If the voltage between these electrodes were to become too great in relation to the concentration of dissolved silver then a sulphide would be formed at the cathode 34 and the quality of the silver plated thereon will be impaired.

The system of the present invention, as will be described hereinafter, operates to maintain a continuous direct current flow between the electrodes 32 and 34. At the same time, the circuit automatically increases the current flow in proportion to the increased concentration of silver in the solution as additional film plates pass through it and it automatically decreases the voltage which causes current flow as the concentration of dissolved silver decreases during plating.

The magnitude of current flow between the electrodes 32 and 34 is controlled by adjustment of the base current on the first NPN transistor 96. This in turn is controlled by the output of the first operational amplifier 106. As the voltage at the negative intput terminal of this amplifier becomes more negative, its output voltage becomes more positive; and consequently, the conductivity of the transistors 102, 100 and 96 increases to permit greater current flow between the electrodes. As this current flow increases, the voltage drop across the reference resistor 98 increases so that a more positive voltage is fed back through the resistor 112 to the negative input terminal of the amplifier 106 to hold its output steady.

The voltage applied to the negative input terminal of the amplifier 106 is controlled by the first field effect transistor 114. When the voltage at its gate terminal becomes more negative, its source to drain resistance decreases and the voltage at its source, which is applied via the resistor 113 to the operational amplifier 106, also becomes more negative.

The voltage on the gate terminal of the field effect transistor 114 is controlled by the operation of the switches 126 and 160 as film plates move through the system. These switches cooperate with charge and discharge control transistors 120 and 142, the P channel field effect transistor 134 and the charge and discharge control capacitors 148 and 150, to maintain a voltage level on the charge control line 116 and at the gate of the first P channel field effect transistor which corresponds, in general, to the instantaneous concentration of silver in the fixer tank 12 and in the silver recovery chamber 22.

When a film plate enters the system and opens the switch 38 to deenergize the relay 258, the switches 126 and 160 switch from their condition shown in FIG. 3 to their alternate condition. The actuation of the switch 160 results in the raising of the voltage at the tap 140 of the voltage divider resistor 138 so that the discharge control transistor 142 is maintained non-conducting. The actuation of the switch 126 however, does operate to connect the emitter of the charge control transistor 120 to the $B^-$ terminal 90 so that that transistor is rendered conductive. The resulting current flow causes the main charge control capacitor 148 to charge negatively. This negative going charge is communicated through the source and drain terminals of the N channel field effect transistor 130 to the discharge control capacitor 150 so that its charge level follows that of the main charge control capacitor 148.

It will be appreciated that the longer the switches 126 and 160 remain in their above described condition, i.e., corresponding to addition of silver from incoming film plates, the more negative will be the charge on the capacitors 148 and 150. This negative going charge acts through the first N channel field effect transistor 114, the operational amplifier 106 and the NPN transistors 102, 100 and 96 to cause more current to flow between the electrodes 32 and 34 to accommodate the increased silver concentration. The rate of charge increase while a film plate is entering the system is adjusted to correspond to the corresponding rate of increase of silver concentration in solution; however, in a normal commercial operation the charge increase rate may be expected to be sufficient to cause the electrical current between the electrodes to increase at a rate of about 0.8 amp per minute. The control resistor 128 serves to maintain a constant current flow through the transistor 120 so that the charge function is linear. The maximum negative charge which the capacitor 148 can attain is limited by the setting of the voltage divider resistance 158. This prevents excess current from flowing between the electrodes, for example, in the event that the switches 126 and 160 become jammed or stuck in one position.

As the trailing end of each film plate passes by the switch 38, it reverts to its normally closed condition to energize the relay 258; and this in turn causes the switches 126 and 160 to be switched to the condition shown in FIG. 3. As can be seen, the emitter of the transistor 120 is thereby disconnected from the $B^-$ terminal 90 so that the transistor ceases to conduct. On the other hand, the voltage divider resistor 138 is no longer connected via the switch 160 to the $B^+$ terminal 88; and instead it is connected via the source and drain terminals of the P channel field effect transistor 134 to the $B^-$ terminal 90. Because of the negative charge previously imposed on the discharge control capacitor 150 the field effect transistor 134 is made conductive; and this causes a voltage drop at the base of the discharge control transistor 142 to render that transistor conductive. The flow of current through this transistor imposes a gradual discharge, i.e., a reduction of the negative charge, on the capacitor 148 and of the voltage applied to the gate of the first P channel field effect transistor 114. As a result, the conductivity of this field effect transistor decreases so that the voltage at its source terminal becomes less negative. This less negative voltage is applied to the operational amplifier 106 which in turn decreases the conductivity of the transistors 102, 100 and 96 to reduce the current flow between the electrodes 32 and 34.

The system is set to reduce the current flow between the electrodes at a rate such that at any instant the current flow corresponds to the silver concentration in the silver recovery chamber 22. Since the current flow between the electrodes 32 and 34 follows the voltage on the charge control line 116, the rate of change of electrode current corresponds to the rate of discharge of the capacitor 148; and this in turn corresponds to the magnitude of current flow through the discharge control transistor 142.

As indicated previously, the negative charge on the capacitor 148 is increased as film plates enter the system so that the maximum amount of current which can be tolerated without sulphiding will flow between the electrodes 32 and 34. As the silver concentration increases, the amount of current which can be tolerated without causing sulphiding also increases. Therefore as the number and length of film plates fed into the system increases to increase the silver concentration in the fixer tank 12 and the silver recovery chamber 22, the amount of current passing between the electrodes 32 and 34 likewise increases so that the rate of silver recovery will be maximized.

When electrode current is high and silver recovery is maximum, however, the resulting change or decrease in silver concentration in the bath is also at a maximum. Therefore, in order for the electrode current to follow silver concentration, it is necessary that the rate of decrease in current be greatest when the silver concentration (and electrode current) is greatest. This reduction in electrode current (which occurs at a rate corresponding to the magnitude of electrode current), is achieved, according to the present invention, by means of the discharge control capacitor 150 and the P channel field effect transistor 134.

As indicated above, when film plates enter the system to increase silver concentration therein, they also open the switch 38 which deenergizes the relay 258 to actuate the switches 126 and 160. As also pointed out above this not only causes the capacitor 148 to charge negatively, but it also causes the capacitor 150 to charge by a corresponding amount. Thereafter, when a film plate completes its entry into the system and the switch 38 recloses to energize the switches 126 and 160 and bring them back to the condition shown in FIG. 3, the negative charge on the main charge control capacitor 148 decreases as explained above. However, the negative charge given to the discharge control capacitor 150 remains constant. This is because the switch 126 maintains the gate of the N channel field effect transistor 130 connected to the $B^-$ terminal 90 and renders that transistor non-conductive. Thus the negative charge remains on the capacitor 150 and is continuously applied to the gate of the P channel field effect transistor 134 to make it conduct at a rate corresponding that negative charge. During this time the lower end of the voltage divider resistor 138 is disconnected by the switch 160 from the $B^+$ terminal 88 and instead it is connected exclusively through the resistor 136 and the source and drain terminals of the field effect transistor 134 to the $B^-$ transistor terminal 90. Thus, as the transistor 134 conducts to a greater degree, due to a more negative charge on the capacitor 150, the potential at the tap 140 and at the base of the discharge control transistor 142 is more negative, thereby causing that transistor to conduct to a greater extent and to effect a more rapid discharge of the capacitor 148. It can be seen from this that the rate of capacitor discharge, when film plates are not entering the system, is proportional to the degree of charge imposed on the capacitors during the time that film plates were entering the system. Consequently, with the system of the present invention, the electrical current applied to the silver containing solution between the electrodes is continuously maintained and is caused to follow the concentration of silver in the solution so that at all times there is applied to the solution the maximum amount of current which can safely be used for silver recovery without causing sulphiding. Moreover, this current is increased in direct proportion to the increase in silver concentration as more or longer film plates are entered into the system in a given length of time; and it is decreased in a non-linear fasion such that it accommodates the greater rate of change in silver concentration which occurs when large currents are applied at high silver concentrations. The rate of discharge and corresponding current reduction in the bath between the electrodes 32 and 34 is roughly such as to result in a complete elimination of charge in approximately 30 minutes.

The remaining portions of the circuit of FIG. 3 serve to provide different alarms and warnings when the system is not operating normally.

The amount of electrical current passing between the electrodes 32 and 34, as indicated above, should be maintained in proper proportion to the silver concentration. The actual current passing between the electrodes produces a corresponding voltage across the reference resistor 98. This voltage is applied via the resistor 189 to the positive input terminal of the over current detection operational amplifier 188 and it is also applied to the negative input terminal of the under current detection operational amplifier 190. The amplifier 190 uses as a reference input, common potential applied via the resistor 198 while the amplifier 188 uses as a reference input the output from the first N channel field effect transistor 114 amplified in the operational amplifier 194 and divided in the voltage divider resistor 192. Should the actual electrode current fall too low, a signal will be produced at the output of the amplifier 190. On the other hand, if the actual electrode current should exceed that called for by the output from the field effect transistor 114, the resulting voltage differential applied to the operational amplifier 188 will cause it to produce an output signal. Output signals from either of the two operational amplifiers 188 and 190 are applied through the resistor 184 to the gate of the first SCR switch 164 to allow current flow through it. As a result, current flows through the normally closed alarm reset switch 162 and through the first indicator lamp 50 and the acoustical alarm 54 to the SCR switch 164, and from there, through the diodes 166 and 168 to ground. Consequently, upon the detection of overcurrent or undercurrent, the first indicator lamp 50 becomes illuminated and the alarm 54 begins to sound continuously.

The temperature within the housing 40 which contains the electrical circuits and components of FIG. 3 is sensed by the thermostatically controlled switches 68 and 108. When the temperature reaches a first level, e.g. 100° F., the switch 68 closes to place the fan motor 70 in circuit with the input power terminals 64 to turn on the fan 72 and to draw cooling air into the housing. Should the temperature rise even higher, e.g. to 140° F., the switch 108 will close to clamp the base of the transistor 102 to common potential and stop the transistor from conducting. As a result the transistors 100 and 96 are made non-conductive and current flow through the electrodes 32 and 34 ceases. In addition, because of the lack of electrode current, the voltage across the reference resistor 98 decreases to zero volts and thereby causes an undercurrent signal to be produced by the operational amplifier 190 so that the first indicator lamp 50 and the acoustical alarm 54 are actuated as explained above.

In the event the switch 38 becomes stuck or jammed in its open condition, or correspondingly, if the switches 126 and 160 should become stuck or jammed in their deenergized condition (opposite to that shown in FIG. 3), so that they remain in that condition for a substantially longer period of time than that corresponding to the entry time of a film plate, then the second indicator lamp 52 and the acoustical alarm 54 become actuated. The manner in which this occurs will now be described.

Before a film plate enters the system, and the switch 160 is in the position shown, the $B^+$ terminal 88 is connected to the base terminals of the NPN transistor 218, the PNP transistor 226. Since normally no gate voltage is present at the second and third SCR switches 172 and 176, this $B^+$ voltage does not cause either of them to conduct. This $B^+$ voltage also maintains the PNP transistor non-conductive; but it does cause the NPN transistor to conduct. This results in current flow from the capacitor 232 through the resistor 216 to common potential and prevents the capacitor 232 from charging.

When a film plate begins to enter the system and the switches 126 and 160 are moved to their other position, the $B^+$ voltage is removed from the bases of the transistors 218. This reduces the base potential at the transistor 218 and 226 to ground so that it ceases to conduct. When the charge corresponding to a predetermined time duration, e.g., 30 seconds, has elasped the charge reaches a level sufficient to trigger the unijunction transistor 212 which then applies a $B^+$ trigger potential to the gate of the third SCR switch 176 rendering that switch conductive. This allows current to flow through the second indicator lamp 52, the diodes 183, the SCR switch 176 and the diodes 166 and 168 to common potential for illumination of the lamp and production of a visual jammed switch alarm. It also allows current to flow through the acoustical alarm 54, and the resistor 174 to and through the SCR switch 176 for actuation of the acoustical alarm and production of an audible "jammed switch" alarm.

When the switch contacts become stuck or jammed in a film entering condition with no film actually entering the system, the amount of electrode current called for becomes greater than that which can be accommodated by the actual concentration of silver in the bath. In order to prevent the sulphiding which might otherwise occur in such a situation, the output of the first operational amplifier 106 becomes clamped to zero potential whenever the above described jammed switch alarms are produced. This clamping to ground occurs because a current path from the output of the operational amplifier is established through the diode 250, the collector and emitter of the transistor 244, the diode 248 and the now triggered third SCR switch 176.

The system may be switched to accommodate the processing of elongated film strips instead of film plates. In such case the alarm arrangement still produces visual and acoustical alarm signals but the acoustical alarm is intermittent. Switching to a continuous film strip processing mode is effected by opening the normally closed processor mode select switch 48. This raises the potential at the gate of the second SCR switch 172 and allows it to conduct. As a result current flows through the second indicator lamp 52 to maintain it illuminated. The transistor 218 is turned off and a charge is applied to the capacitor 232 by the transistor 226. The unijunction transistor 212 is triggered and the SCR switch 176 is rendered conductive. When this happens however, current from the second indicator lamp 52 does not flow through the third SCR switch 176 but instead it continues to flow through the second SCR switch 172. This is because the voltage drop across the lamp 52 and the resistor 169 result in a voltage at the anode of the first diode 183 lower than that at its cathode. Thus, only current from the acoustical alarm 54 passes through the third SCR switch 176.

The acoustical alarm 54 has an internal resistance such that the amount of current which passes through it during actuation is very low; in fact it is too low by itself to sustain conduction of the third SCR switch even when a gate trigger voltage is applied. When the SCR switch 176 becomes non-conductive, current passing through the acoustical alarm 54 passes through the resistor 252 to charge the capacitor 254. When the capacitor 254 accumulates a substantial charge, current through the alarm reduces and the alarm silences. When the SCR switch 176 again pulses the alarm will turn on the capacitor 254 will discharge.

The alarms may be terminated by opening the reset switch 162 which interrupts all current flow through them and renders the SCR switches 164, 172 and 176 non-conductive.

At any time during operation of the system the amount of electrical current passing between the electrodes 32 and 34 can be manually adjusted by actuation of the switch 256 so as to increase or decrease the negative potential on the charge control line 116 and at the gate of the first P channel field effect transistor.

Although a particular embodiment of the invention is herein disclosed for purposes of explanation, various modifications thereof, after study of this specification, will be apparent to those skilled in the art to which the invention pertains.

What is claimed and desired to be secured by Letters Patent is:

1. A film processing apparatus comprising a tank for containing a fixer bath into which silver containing materials pass from film moving into and through said bath, an electrically chargeable device, first charging circuit means connectable to said chargeable device for charging said chargeable device in one direction at a first predetermined rate during movement of film into said bath, second charging circuit means connectable to said chargeable device for charging said chargeable device in the opposite direction at a second predetermined rate following movement of film into said bath, a pair of electroplating electrodes mounted to extend into said bath, electrical current supply means arranged to cause electroplating current to flow through said electrodes and through said bath at a magnitude corresponding to the charge on said chargeable device and switch means responsive to movement of film into said bath and arranged to maintain said first charging circuit means connected to said chargeable device during movement of film into said bath and to maintain said second charging circuit means connected to said chargeable device following movement of film into said bath.

2. A film processing apparatus according to claim 1 wherein said first charging circuit means includes a transistor having a feedback connection to provide a linear charge characteristic to said chargeable device.

3. A film processing apparatus according to claim 1 wherein said second charging circuit means includes means for maintaining said second predetermined rate in accordance with the charge on said chargeable device when a film completes its movement into said bath.

4. A film processing apparatus according to claim 1 wherein said chargeable device comprises a main capacitor.

5. A film processing apparatus according to claim 4 wherein said second charging circuit means comprises a second capacitor and a current flow control device, said current flow control device being connected to charge said main capacitor in said opposite direction in accordance with the charge on said second capacitor and said second capacitor being connected to be charged by said first charging circuit means.

6. A film processing apparatus according to claim 5 wherein further switch means are interposed between said first charging circuit means and said second capacitor, said further switch means being actuable with the first mentioned switch means to maintain said second capacitor disconnected from said first charging circuit means during charging of said main capacitor in said first direction.

7. A film processing apparatus according to claim 5 wherein said second charging circuit includes a field effect transistor having its gate terminal connected to said second capacitor.

8. A film processing apparatus according to claim 6 wherein the first mentioned switch means is arranged to permit current flow in said first and second charging circuits, alternately, in accordance with film movement and absence of film movement, respectively, into said bath.

9. A film processing apparatus according to claim 1 wherein said electrical circuit further includes means for generating a control signal corresponding to the magnitude of charge on said chargeable device, means for generating a detection signal in response to the current flowing through said electrodes, means for comparing said control signal and said detection signal and alarm means operative in response to the occurrence of a predetermined discrepancy between the control and detection signals.

10. A film processing apparatus according to claim 9 wherein said means for generating a detection signal comprises a reference resistor connected in series with said electrodes and means for sensing the voltage across said reference resistor.

11. A film processing apparatus according to claim 10 wherein said means for comparing said control signal and said detection signal comprises at least one operational amplifier having one terminal connected to receive voltage corresponding to the voltage developed across said reference resistor and having a second terminal connected to receive voltages corresponding to the charge on said chargeable device.

* * * * *